US006656674B2

(12) United States Patent
Royster, Jr. et al.

(10) Patent No.: US 6,656,674 B2
(45) Date of Patent: Dec. 2, 2003

(54) ULTRATHIN TABULAR GRAIN SILVER HALIDE EMULSION WITH IMPROVED PERFORMANCE IN MULTILAYER PHOTOGRAPHIC ELEMENT

(75) Inventors: Tommie L. Royster, Jr., Rochester, NY (US); John E. Keevert, Jr., Rochester, NY (US); Sharon G. Johnston, Pittsford, NY (US); Donald L. Black, Webster, NY (US); David W. Sandford, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 46 days.

(21) Appl. No.: 10/027,300

(22) Filed: Dec. 21, 2001

(65) Prior Publication Data

US 2003/0152877 A1 Aug. 14, 2003

(51) Int. Cl.[7] ..... G03C 1/005; G03C 1/494

(52) U.S. Cl. ..... 430/568; 430/567; 430/502; 430/503; 430/506

(58) Field of Search ..... 430/52, 503, 567, 430/506, 568

(56) References Cited

U.S. PATENT DOCUMENTS 4,435,501 A 3/1984 Maskasky
5,250,403 A 10/1993 Antoniades et al.
5,300,413 A * 4/1994 Sutton et al. ..... 430/567
5,503,971 A * 4/1996 Daubendiek et al. ..... 430/567
5,576,168 A 11/1996 Daubendiek et al.
5,962,206 A 10/1999 Hall
6,534,256 B2 * 3/2003 Kiyoto ..... 430/567

* cited by examiner

*Primary Examiner*—Geraldine Letscher
(74) *Attorney, Agent, or Firm*—Andrew J. Anderson

(57) ABSTRACT

A photographic element which comprises a support bearing: (i) a first radiation-sensitive silver halide emulsion image-forming layer comprising a high bromide tabular grain emulsion including tabular grains having {111} major faces, exhibiting an average thickness of at least 0.07 $\mu$m and an average aspect ratio of at least 2; and (ii) a second radiation-sensitive silver halide emulsion image-forming layer comprising an ultrathin tabular grain emulsion including tabular grains having {111} major faces, containing greater than 70 mole percent bromide and at least 0.25 mole percent iodide, exhibiting an average thickness of less than 0.07 $\mu$m and an average equivalent circular diameter of at least 0.7 $\mu$m, and having latent image forming chemical sensitization sites on the surfaces of the tabular grains; wherein the surface chemical sensitization sites include epitaxially deposited silver halide protrusions containing an actual chloride concentration of from 20–50 mole %, based on epitaxially deposited silver, the chloride concentration being at least 10 mole percent higher than that of the tabular grains, and containing an actual iodide concentration of from 1 to 7 mole %, based on epitaxially deposited silver.

12 Claims, No Drawings

ULTRATHIN TABULAR GRAIN SILVER HALIDE EMULSION WITH IMPROVED PERFORMANCE IN MULTILAYER PHOTOGRAPHIC ELEMENT

FIELD OF THE INVENTION

This invention relates to a photographic element of the successive layer type which contains a plurality of silver halide emulsion image-forming layers where the imaging layers comprise separate silver halide emulsions, at least one of which comprises tabular grains having a thickness of at least 0.07 micrometers and at least one of which comprises tabular grains having a thickness of less than 0.07 micrometers.

BACKGROUND OF THE INVENTION

Color photographic materials conventionally employ silver halide emulsions in so-called "successive layer" structures, such as for example where a support has provided successively thereon one or more red-sensitive layer, one or more green sensitive layer, and one or more blue sensitive layer.

In Antoniades et al., U.S. Pat. No. 5,250,403, there are described multilayer photographic elements that use tabular grain emulsions in which tabular grains having {111} major faces account for greater than 97 percent of total grain projected area. The tabular grains have an equivalent circular diameter (ECD) of at least 0.7 $\mu$m and a mean thickness of less than 0.07 $\mu$m. Tabular grain emulsions with mean thicknesses of less than 0.07 $\mu$m are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

Maskasky U.S. Pat. No. 4,435,501, discloses that use of a site director, such as iodide ion, an aminoazaindene, or a selected spectral sensitizing dye, adsorbed to the surfaces of host tabular grains is capable of directing silver salt epitaxy to selected sites, typically the edges and/or corners, of the host grains. Depending upon the composition and site of the silver salt epitaxy, significant increases in speed may be observed. The most highly controlled site depositions (e.g., corner specific epitaxy siting) and the highest reported photographic speeds reported by U.S. Pat. No. 4,435,501 were obtained by epitaxially depositing silver chloride onto silver iodobromide tabular grains. U.S. Pat. No. 4,435,501 recognized that even when chloride is the sole halide run into a tabular grain emulsion during epitaxial deposition, a minor portion of the halide contained in the host tabular grains can migrate to the silver chloride epitaxy. U.S. Pat. No. 4,435,501 offers as an example the inclusion of minor amounts of bromide ion when silver and chloride ions are being run into a tabular grain emulsion during epitaxial deposition.

In Daubendiek et al. U.S. Pat. No. 5,576,168, sensitized silver iodobromide ultrathin emulsions are disclosed, wherein during sensitization silver and halide ions including iodide and chloride ions are added to ultrathin tabular host grains to deposit epitaxially on up to 50 percent of the surface area of the tabular grains silver halide protrusions containing at least a 10 mole percent higher chloride concentration than the tabular grains and an iodide concentration that is increased by the iodide ion addition. The resulting epitaxially sensitized ultrathin tabular grain emulsions are observed to provide increased speed and contrast as well as improvements in speed-granularity relationships. While the use of epitaxially sensitized ultrathin grain emulsions in multilayer formats is suggested in U.S. Pat. No. 5,576,168, performance is evaluated in single emulsion layer elements.

Hall U.S. Pat. No. 5,962,206 specifically discloses the use of significant percentages (based on total imaging silver halide) of ultrathin tabular emulsions, including those having epitaxial sensitization of the type disclosed in U.S. Pat. No. 5,576,168, in multilayer color photographic elements in combination with limited levels of thicker tabular grain emulsions and non-tabular grain emulsions. Due to the recognized interchangeability of photographic properties, the advantages of incorporating an emulsion layer comprising ultrathin tabular grains can be realized in speed, silver level, sharpness or graininess. While the use of a relatively high proportion of ultrathin tabular grains relative to other tabular and non-tabular grain emulsions in a photographic element may be theoretically possible, it may also be desirable to use only a minor fraction of ultrathin tabular grain emulsions (relative to total imaging silver). Use of relatively thicker (i.e., non-ultrathin) tabular grain emulsions in upper light sensitive records may be desired in combination with ultrathin tabular grain emulsions in lower records, in order to provide desired reflectivity properties and associated optical advantage. It has been found, however, that when some epitaxially sensitized ultrathin tabular grain emulsion of the type disclosed in U.S. Pat. No. 5,576,168 are employed in multilayer elements in combination with conventional thicker high bromide tabular grain emulsions, speed advantages demonstrated for the ultrathin tabular emulsions in single emulsion layer formats may be significantly compromised.

It would be desirable to provide a multilayer photographic element including both a first imaging layer containing a conventional thickness tabular grain emulsion as well as a second imaging layer containing an epitaxially sensitized ultrathin tabular grain emulsion, while maintaining the speed advantages provided by epitaxially sensitized ultrathin tabular grain emulsions.

SUMMARY OF THE INVENTION

The present invention provides a photographic element which comprises a support bearing: (i) a first radiation-sensitive silver halide emulsion image-forming layer comprising a tabular grain emulsion comprised of silver halide grains including tabular grains having {111} major faces, containing greater than 50 mole percent bromide, based on silver, accounting for greater than 50 percent of total grain projected area, exhibiting an average thickness of at least 0.07 $\mu$m and an average aspect ratio of at least 2; and (ii) a second radiation-sensitive silver halide emulsion image-forming layer comprising an ultrathin tabular grain emulsion comprised of silver halide grains including tabular grains having {111} major faces, containing greater than 70 mole percent bromide and at least 0.25 mole percent iodide, based on silver, accounting for greater than 90 percent of total grain projected area, exhibiting an average thickness of less than 0.07 $\mu$m and an average equivalent circular diameter of at least 0.7 $\mu$m, and having latent image forming chemical sensitization sites on the surfaces of the tabular grains; wherein the surface chemical sensitization sites include epitaxially deposited silver halide protrusions forming epitaxial junctions with the tabular grains, the protrusions exhibiting an isomorphic face centered cubic crystal lattice structure, located on up to 50 percent of the surface area of the tabular grains, containing an actual chloride concentration of from 20–50 mole %, based on epitaxially deposited silver, the chloride concentration being at least 10 mole percent higher than that of the tabular grains, and containing an actual iodide concentration of from 1 to 7 mole %, based on epitaxially deposited silver.

In preferred embodiments of the invention, the epitaxially deposited silver halide protrusions of the ultrathin tabular grain emulsion comprise from 0.5–7 mole percent (more preferably 1–6 mole percent, and most preferably 3–6 mole percent), based on total silver of the host tabular grains. Photographic elements in accordance with the invention are particularly useful where tabular grains of the second silver halide emulsion layer having a thickness of less than 0.07 μm comprise from 1 to 25 wt % (more preferably less than 20 wt %, and most preferably less than 15 wt %) of the total imaging silver halide content of the element.

The invention also provides a method for forming an image in an exposed photographic material, comprising a support bearing one or more silver halide emulsion image-forming layers, comprising developing the photographic material with a silver halide developing agent, characterized in that the photographic material is an element as hereinbefore defined.

The results of the invention employing specific epitaxial sensitization deposits are an improvement over the multilayer position demonstrated by the use of epitaxially sensitized ultrathin tabular grain emulsions outside the invention.

DETAILED DESCRIPTION OF THE INVENTION

The invention is directed to an improvement in epitaxially sensitized ultrathin tabular grain photographic emulsions employed in combination with thicker tabular grain emulsions in mutilayer elements. The combination of emulsions is specifically contemplated for incorporation in camera speed color photographic films.

As used herein the term "imaging silver" is intended to include all silver present in the photographic element as a silver halide except silver halide present in grains having an equivalent circular diameter (ECD) less than 0.15 μm. It does not include silver which is not present in the halide form, such as that employed in elemental form for purposes other than forming an image such as for filter or antihalation purposes. Viewed mathematically, imaging silver includes the total silver in the element less the silver present in other than the halide form and less the silver present in the halide form in grains sizes less than 0.15 μm ECD.

As used herein, the term "tabular" grain refers to silver halide grains having an aspect ratio of at least 2, where aspect ratio is defined as the equivalent circular diameter (ECD) of the major face of the grain divided by the grain thickness. Tabular grain emulsions with mean tabular grain thicknesses of less than 0.07 μm are herein referred to as "ultrathin" tabular grain emulsions. Preferably, both the ultrathin grain and the thicker tabular grain emulsions used in accordance with the invention each have an average tabularity (T) of greater than 25 (more preferably greater than 100), where the term "tabularity" is employed in its art recognized usage as $T=ECD/t^2$ where ECD is the average equivalent circular diameter of the tabular grains in micrometers and t is the average thickness in micrometers of the tabular grains. Tabularity increases markedly with reductions in tabular grain thickness. Preferably, the any non-ultrathin tabular grain emulsions used in accordance with the invention, while having an average thickness of at least 0.07 micrometers, have an average thickness of less than 0.3 micrometers for green or red sensitized emulsions, and 0.5 micrometers for blue sensitive emulsions.

Concerning tabular grains in general, to maximize the advantages of high tabularity it is generally preferred that tabular grains satisfying the stated criteria account for the highest conveniently attainable percentage of the total grain projected area of an emulsion, with at least 50% total grain projected area (%TGPA) being typical. For example, in preferred emulsions, tabular grains satisfying the stated criteria above account for at least 70 percent of the total grain projected area. In the highest performance tabular grain emulsions, tabular grains satisfying the criteria above account for at least 90 percent of total grain projected area.

Suitable tabular grain emulsions used in accordance with the invention which are comprised of high bromide silver halide grains (containing greater than 50 mole percent bromide, based on silver) having {111} major faces which account for greater than 50 percent of total grain projected area and which exhibit an average thickness of at least 0.07 μm and an average aspect ratio of at least 2 can be selected from among a variety of conventional teachings. The high bromide tabular grain emulsions preferably contain greater than 70 mole percent, and optimally at least 90 mole percent bromide, based on total silver. In one form the high bromide tabular grains can be silver bromide grains. Silver chloride, like silver bromide, forms a face centered cubic crystal lattice structure. Therefore, all of the halide not accounted for by bromide can be chloride, if desired. Chloride preferably accounts for no more than 20 mole percent, most preferably no more than 15 mole percent of total silver. Iodide can be present in concentrations ranging up to its saturation limit, but is usually limited to 20 mole percent or less, preferably 12 mole percent or less. Silver iodobromide grains represent a preferred form of high bromide tabular grains. Silver chloroiodobromide and iodochlorobromide tabular grains are also contemplated. Representative high bromide tabular grain emulsions include those described in the following references: *Research Disclosure*, Item 22534, January 1983, published by Kenneth Mason Publications, Ltd., Emsworth, Hampshire P010 7DD, England; Daubendiek et al U.S. Pat. No. 4,414,310; Solberg et al U.S. Pat. No. 4,433,048; Wilgus et al U.S. Pat. No. 4,434,226; Maskasky U.S. Pat. No. 4,435,501; Kofron et al U.S. Pat. No. 4,439,520; Yamada et al U.S. Pat. No. 4,647,528; Sugimoto et al U.S. Pat. No. 4,665,012; Daubendiek et al U.S. Pat. No. 4,672,027; Yamada et al U.S. Pat. No. 4,679,745; Daubendiek et al U.S. Pat. No. 4,693,964; Maskasky U.S. Pat. No. 4,713,320; Nottorf U.S. Pat. No. 4,722,886; Sugimoto U.S. Pat. No. 4,755,456; Goda U.S. Pat. No. 4,775,617; Ellis U.S. Pat. No. 4,801,522; Ikeda et al U.S. Pat. No. 4,806,461; Ohashi et al U.S. Pat. No. 4,835,095; Makino et al U.S. Pat. No. 4,835,322; Daubendiek et al U.S. Pat. No. 4,914,014; Aida et al U.S. Pat. No. 4,962,015; Ikeda et al U.S. Pat. No. 4,985,350; Piggin et al U.S. Pat. No. 5,061,609; Piggin et al U.S. Pat. No. 5,061,616; Tsaur et al U.S. Pat. No. 5,210,013; Black et al U.S. Pat. No. 5,219,720; Kim et al U.S. Pat. No. 5,236,817; Brust U.S. Pat. No. 5,248,587; Tsaur et al U.S. Pat. No. 5,252,453; Kim et al U.S. Pat. No. 5,272,048; Delton U.S. Pat. No. 5,310,644; Black et al U.S. Pat. No. 5,334,495; Chaffee et al U.S. Pat. No. 5,358,840; Delton U.S. Pat. No. 5,372,927; Cohen et al U.S. Pat. No. 5,391,468; Maskasky U.S. Pat. No. 5,411,851; Maskasky U.S. Pat. No. 5,411,853; Maskasky U.S. Pat. No. 5,418,125; Delton U.S. Pat. No. 5,460,934; Wen U.S. Pat. No. 5,470,698.

The epitaxially sensitized ultrathin tabular grain emulsions used in the elements of the invention can be realized by chemically and spectrally sensitizing any conventional ultrathin tabular grain emulsion in which the tabular grains have {111} major faces; contain greater than 70 mole percent bromide and at least 0.25 mole percent iodide, based on silver; account for greater than 90 percent of total grain projected area; exhibit an average ECD of at least 0.7 μm; and exhibit an average thickness of less than 0.07 μm. Although these criteria are too stringent to be satisfied by the vast majority of known tabular grain emulsions, a few published precipitation techniques are capable of producing emulsions satisfying these criteria. U.S. Pat. No. 5,250,403, cited above and here incorporated by reference, demonstrates preferred silver iodobromide emulsions satisfying these criteria. Zola and Bryant EP 0 362 699 also discloses silver iodobromide emulsions satisfying these criteria. Daubendiek et al. U.S. Pat. No. 5,576,168 discloses further preferred procedures for preparation of ultrathin tabular grains, the disclosures of which are incorporated by reference herein.

The ultrathin tabular grains account for at least 90 percent of total grain projected area of the ultrathin grain emulsion and contain at least 70 mole percent bromide and at least 0.25 mole percent iodide, based on silver. Unless otherwise stated, references to the composition of the ultrathin tabular grains exclude the silver halide epitaxy. It is also possible to include minor amounts of chloride ion in the ultrathin tabular grains. These ultrathin tabular grains thus may include silver iodobromide, silver iodochlorobromide and silver chloroiodobromide grains, where the halides are named in their order of ascending concentration.

For camera speed films it is generally preferred that the tabular grains contain at least 0.5 (and more preferably at least 1.0) mole percent iodide, based on silver. Although the saturation level of iodide in a silver bromide crystal lattice (generally cited as about 40 mole percent) is a commonly cited limit for iodide incorporation, for photographic applications iodide concentrations seldom exceed 20 mole percent and are typically in the range of from about 1 to 12 mole percent.

As disclosed by Delton U.S. Pat. No. 5,372,972, ultiathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton, corresponding to Curves A and B of Piggin et al U.S. Pat. Nos. 5,061,609 and 5,061,616. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

Iodide can be uniformly distributed within the ultrathin tabular grains. To obtain a further improvement in speed-granularity relationships it is preferred that the iodide distribution satisfy the teachings of Solberg et al U.S. Pat. No. 4,433,048. Since iodide in the ultrathin tabular grains is only required in the regions of the grains that are to form epitaxial junctions with the silver halide epitaxy, it is contemplated to nucleate and grow the ultrathin tabular grains as silver bromide ultrathin tabular grains until late in the precipitation process. This allows the overall concentrations of iodide in the ultrathin tabular grains to be maintained at low levels while satisfying the required iodide concentrations in the area receiving silver halide epitaxy. The silver iodobromide grain precipitation techniques, including those of U.S. Pat. No. 5,250,403 and EP 0 362 699, can be modified to silver bromide tabular grain nucleation and growth simply by omitting iodide addition, thereby allowing iodide incorporation to be delayed until late in the precipitation. U.S. Pat. No. 4,439,520 teaches that tabular grain silver iodobromide and bromide precipitations can differ solely by omitting iodide addition for the latter.

The ultrathin tabular grains produced by the teachings of U.S. Pat. No. 5,250,403, EP 0 362 699 and U.S. Pat. No. 5,372,972 all have {111} major faces. Such tabular grains typically have triangular or hexagonal major faces. The tabular structure of the grains is attributed to the inclusion of parallel twin planes.

The ultrathin tabular grain emulsions employed in the elements of the invention comprise ultrathin tabular grains which account for greater than 90 percent of total grain projected area of the emulsion. Ultrathin tabular grain emulsions in which the tabular grains account for greater than 97 percent of total grain projected area can be produced by the preparation procedures taught by U.S. Pat. No. 5,250,403 and are preferred. U.S. Pat. No. 5,250,403 reports emulsions in which >99% (substantially all) of total grain projected area is accounted for by tabular grains. Similarly, U.S. Pat. No. 5,372,972 reports that substantially all of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area of the ultrathin grain emulsion exhibit an average ECD of at least 0.7 μm. The advantage to be realized by maintaining the average ECD of at least 0.7 μm is demonstrated in Tables Ill and IV of U.S. Pat. No. 5,250,403. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions employed in the elements of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by U.S. Pat. No. 5,250,403 these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of U.S. Pat. No. 5,250,403, U.S. Pat. No. 4,439,520 suggests a practical minimum tabular grain thickness about 0.01 μm.

Preferred ultrathin tabular grain emulsions are those in which grain to grain variance is held to low levels. U.S. Pat. No. 5,250,403 reports ultrathin tabular grain emulsions in which greater than 90 percent of the tabular grains have hexagonal major faces. U.S. Pat. No. 5,250,403 also reports ultrathin tabular grain emulsions exhibiting a coefficient of variation (COV) based on ECD of less than 25 percent and even less than 20 percent. Disproportionate size range reductions in the size-frequency distributions of ultrathin tabular grains having greater than mean ECD's (hereinafter referred to as the $>ECD_{av.}$ grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent. Any of the conventional techniques for oxidizing the methionine of a gelatino-peptizer can be employed, such as discussed in U.S. Pat. No. 5,576,168.

In the practice of the present invention ultrathin tabular grains receive during chemical sensitization epitaxially deposited silver halide forming protrusions at selected sites on the ultrathin tabular grain surfaces. U.S. Pat. No. 4,435,501 observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host ultrathin tabular grains. It would be more precise to reference the higher chloride concentration in the silver halide protrusions to the chloride ion concentration in the epitaxial junction forming portions of the ultrathin tabular grains, but this is not necessary, since the chloride ion concentrations of the ultrathin tabular grains are contemplated to be substantially uniform (i.e., to be at an average level) or to decline slightly at the host gain surface relative to the total host grain chloride concentrations due to iodide displacement in the epitaxial junction regions.

Contrary to the teachings of U.S. Pat. No. 4,435,501, it was found in U.S. Pat. No. 5,576,168 that improvements in photographic speed and contrast can be realized by adding iodide ions along with silver and chloride ions to the ultrathin tabular grain emulsions while performing epitaxial deposition. This results in increasing the concentration of iodide in the epitaxial protrusions above the low (substantially less than 1 mole percent) levels of iodide that migrate from the host iodobromide host tabular grains during silver and chloride ion addition. Although any increase in the iodide concentration of the face centered cubic crystal lattice structure of the epitaxial protrusions improves photographic performance, it is preferred to increase the iodide concentration to a level of at least 1.0 mole percent, preferably at least 1.5 mole percent, based on the silver in the silver halide protrusions.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603. Further increases in speed and contrast can be realized by introducing bromide ions along with silver, chloride, and iodide ions during epitaxial deposition. Analysis indicates that the introduction of chloride and bromide ions together during precipitation of the epitaxial protrusions facilitates higher iodide incorporations. This can be explained in terms of the increased crystal cell lattice dimensions imparted by the increased levels of bromide ions.

In accordance with the invention, the highest levels of retained photographic speed advantage attributable to the use of an epitaxially sensitized ultrathin grain emulsion in a multilayer element comprising both an ultrathin tabular grain emulsion and a thicker tabular grain emulsion is realized when the silver halide epitaxy deposited on the ultrathin grain emulsion contains both (1) an actual chloride concentration of from 20–50 mole %, based on epitaxially deposited silver, the chloride concentration being at least 10 mole percent higher than that of the tabular grains, and (2) an actual iodide concentration of from 1 to 7 mole %, based on epitaxially deposited silver, in the face centered cubic crystal lattice structure of the protrusions.

Due to the different solubilities of different silver halides and migration of halide ions from the host tabular grain, the actual halide concentrations of the epitaxial deposits is highly dependent upon the relative amount of epitaxy deposited as well as the nominal (input) halide percentages added during epitaxial deposition, and the resulting actual halide concentrations can vary significantly from the nominal halide percentages added. Analytical electron microscopy (AEM) techniques may be employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron Microscopy*/1977, Vol. 1, IIT Research Institute, March 1977, p. 651. The composition of an individual epitaxial protrusion may be determined by focusing an electron beam to a size small enough to irradiate only the protrusion being examined. The selective location of the epitaxial protrusions at the corners of the host tabular grains can facilitate addressing only the epitaxial protrusions.

Changes in the actual epitaxial composition which may result from changing the percent of epitaxy while maintaining the same nominal compositions can be understood by considering the source of bromide incorporated into the epitaxy. Excess free bromide inherent in silver iodobromide emulsions provides a significant source of bromide for epitaxial growth. As the mole percentage of added nominally primarily chloride epitaxy decreases without changing the ratio of added halides, the percentage of bromide incorporated into the epitaxy will increase (since the total contribution from the emulsion will be relatively constant) while the percentage of chloride decreases. An increase in the actual percentage of bromide may also result in a larger lattice, and increase the efficiency of iodide incorporation. Having a high level of host grain surface iodide may also promote higher incorporation of iodide during the epitaxial deposition step.

In order to obtain actual epitaxial deposition halide concentrations as specified for the present invention, it is generally preferable to use relatively high nominal levels of chloride ions added during epitaxial deposition, or to limit the percentage of host grain surface iodide. Such procedures are especially important when using relatively low levels of epitaxy (e.g., where the epitaxially deposited silver halide protrusions of the ultrathin tabular grain emulsion comprise from 0.5–7 mole percent, more preferably 1–6 mole percent, and most preferably 3–6 mole percent, based on total silver of the host tabular grains).

Subject to the composition modifications specifically described above, prefered techniques for chemical and spectral sensitization are those described by U.S. Pat. No. 4,435,501 cited above and here incorporated by reference, which discloses improvements in sensitization by epitaxially depositing silver halide at selected sites on the surfaces of the host tabular grains. Like U.S. Pat. No. 4,435,501, nominal amounts of silver halide epitaxy (as low as 0.05 mole percent, based on total silver, where total silver includes that in the host and epitaxy) may be effective in the practice of the invention. Speed increases observed are attributed to restricting silver halide epitaxy deposition to a small fraction of the host tabular grain surface area. It is contemplated to restrict silver halide epitaxy to less than 50 percent of the ultrathin tabular grain surface area and, preferably, to a much smaller percent of the ultrathin tabular grain surface area. Specifically, silver halide epitaxy may be restricted to less than 25 percent, preferably less than 10 percent, and optimally less than 5 percent of the host grain surface area. When the ultrathin tabular grains contain a lower iodide concentration central region and a higher iodide laterally displaced region, it is preferred to restrict the silver halide epitaxy to those portions of the ultrathin tabular grains that are formed by the laterally displaced regions, which typically includes the edges and corners of the tabular grains.

U.S. Pat. No. 4,435,501 teaches various techniques for restricting the surface area coverage of the host tabular grains by silver halide epitaxy that can be applied in forming the emulsions of this invention. U.S. Pat. No. 4,435,501 teaches employing spectral sensitizing dyes that are in their aggregated form of adsorption to the tabular grain surfaces capable of directing silver halide epitaxy to the edges or corners of the tabular grains. Cyanine dyes that are adsorbed to host ultrathin tabular grain surfaces in their J-aggregated form constitute a specifically preferred class of site directors. U.S. Pat. No. 4,435,501 also teaches' to employ non-dye adsorbed site directors, such as aminoazaindenes (e.g., adenine) to direct epitaxy to the edges or corners of the tabular grains. In still another form U.S. Pat. No. 4,435,501 relies on overall iodide levels within the host tabular grains of at least 8 mole percent to direct epitaxy to the edges or corners of the tabular grains. In yet another form U.S. Pat. No. 4,435,501 adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. U.S. Pat. No. 4,435,501 teaches that slowing the rate of epitaxial deposition can reduce t h e number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. When the host ultrathin tabular grains contain a higher iodide concentration in laterally displaced regions, as taught by Solberg et al, it is recognized that enhanced photographic performance is realized by restricting silver halide protrusions to the higher iodide laterally displaced regions. Further, as disclosed in concurrently filed, copending, commonly assigned U.S. Ser. No. 10/027,285 filed Dec. 21, 2001, the disclosure of which is incorporated by reference herein, the uniformity of siting of epitaxial depositions on the corners of host tabular grains, particularly in the case where the epitaxial depositions comprise a relatively low molar percent based on the total silver of the host grains (e.g., from 0.5 to 7 mole percent), may be improved by adding a thiosulfonate compound to the host emulsion grain surface prior to epitaxial deposition, such that most grains will have epitaxial depositions on the majority of their grain corners.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure* December 1989, Item 308119, Section III. Chemical sensitization. U.S. Pat. No. 4,439,520 illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingswoith U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

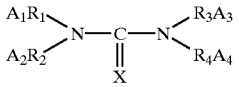

(V)

wherein

X is sulfur, selenium or tellurium, each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion, and $L^1$ is a Lewis acid donor.

U.S. Pat. No. 4,439,520 discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. U.S. Pat. No. 4,435,501 teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by U.S. Pat. No. 4,439,520, particularly the blue spectral sensitizing dyes shown by structure and their longer methine chain analogous that exhibit absorption maxima in the green and red portions of the spectrum, are particularly preferred for incorporation in the ultrathin tabular grain emulsions of the invention. The selection of J-aggregating blue absorbing spectral sensitizing dyes for use as site directors is specifically contemplated. A general summary of useful spectral sensitizing dyes is provided by *Research Disclosure*, December 1989, Item 308119, Section IV. Spectral sensitization and desensitization, A. Spectral sensitizing dyes.

While in specifically preferred forms of the invention a spectral sensitizing dye can act also as a site director and/or can be present during the finish, the only required function that a spectral sensitizing dye perform is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

Aside from the features of tabular grain emulsions described above, emulsions employed in this invention and their preparation can take any desired conventional form. For example, in accordance with conventional practice, after an emulsion satisfying the requirements of the invention has been prepared, it can be blended with one or more other emulsions. Conventional emulsion blending is illustrated in *Research Disclosure*, Vol. 308, Item 308119, Section I, Paragraph I, the disclosure of which is here incorporated by reference.

The photographic elements of the invention are preferably multicolor elements which contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the 35 elements of this invention, reference will be made to *Research Disclosure*, September 1994, Item 36544, available as described above, which will be identified hereafter by the term "Research Disclosure". Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers arepyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Pat. No. 2,097,140; UK. Pat. No. 2,131,188); electron transfer agents (U.S. Pat. No. 4,859,578; U.S. 4,912,025); antifogging and anti color-mixing agents such as derivatives of hydroquinones, aminophenols, amines, gallic acid; catechol; ascorbic acid, hydrazides; sulfonamidophenols, and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570, U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886, 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

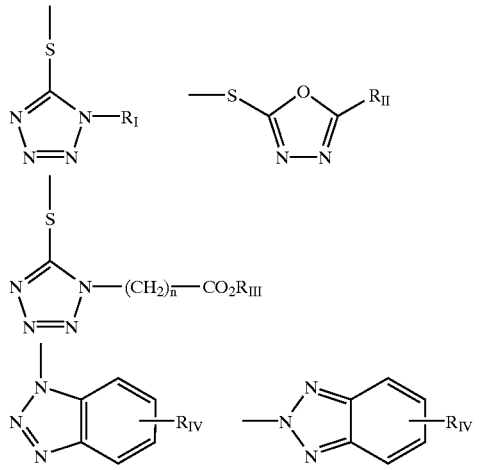

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845, Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

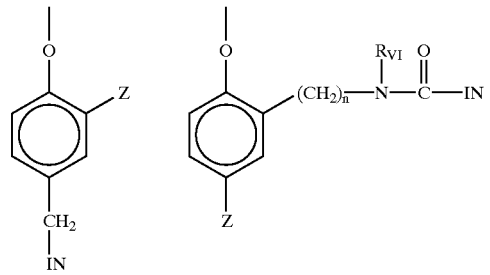

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

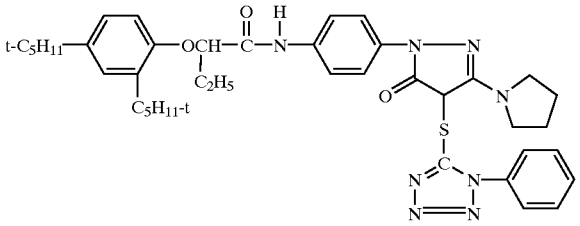

D2

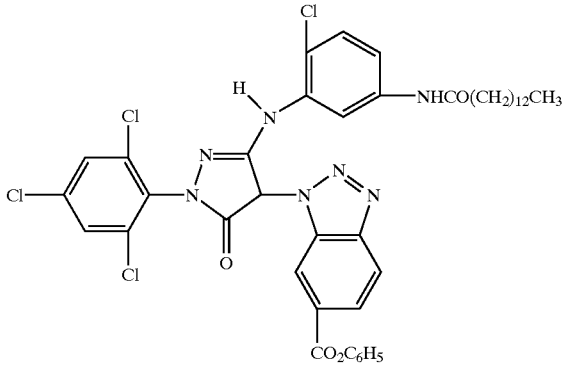

-continued
D3
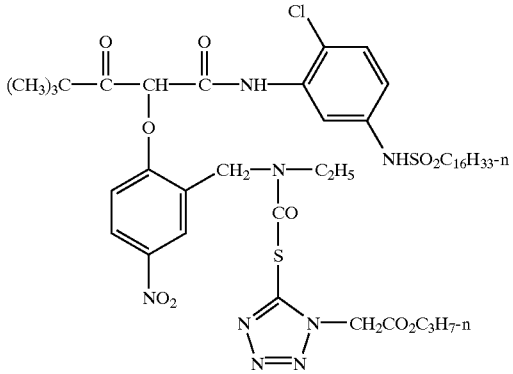
D4
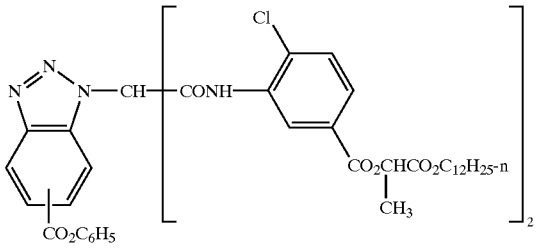
D5
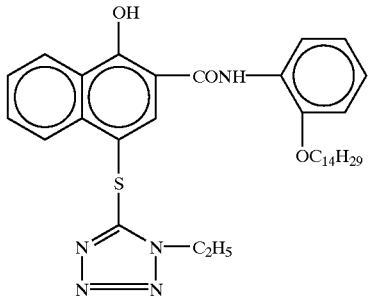
D6
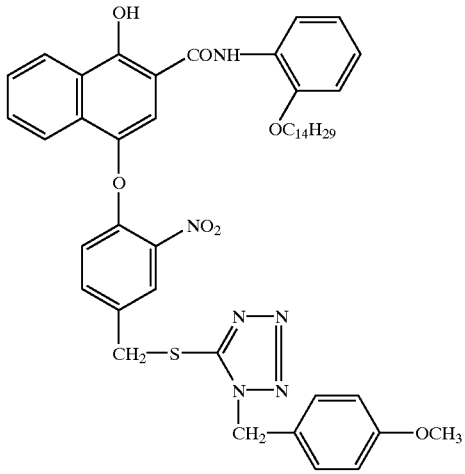
-continued
D7
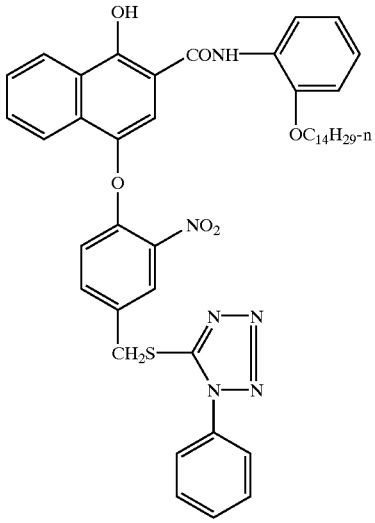
D8
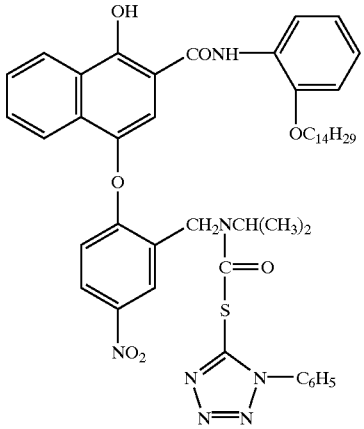
D9
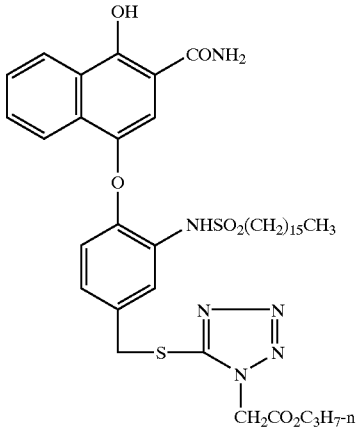

-continued

D10

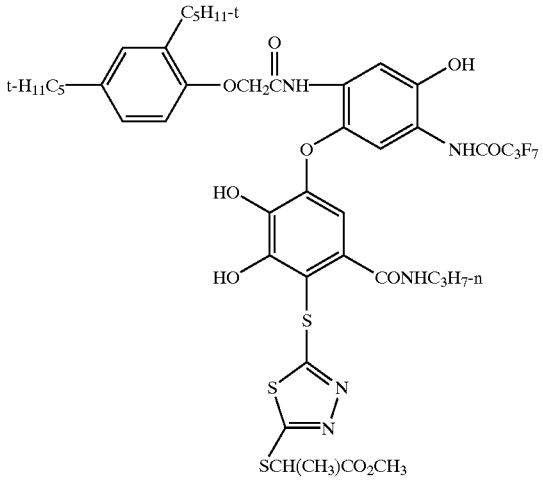

D11

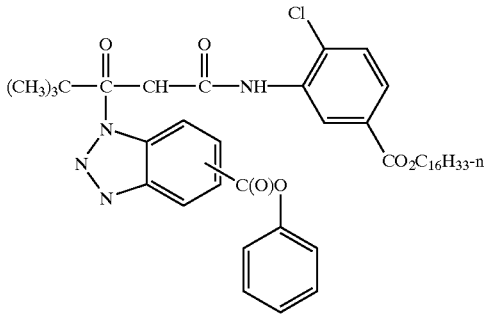

D12

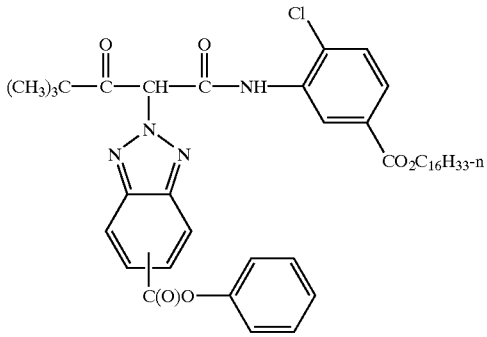

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in the *British Journal of Photography Annual of* 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

The invention can be better appreciated by reference to following specific examples, wherein epitaxially sensitized ultrathin emulsions are prepared and coated in single layer and multilayer formats. Photographic speeds are reported as relative log speeds, where a speed difference of 30 log units equals a speed difference of 0.3 log E, where E represents exposure in lux-seconds. Halide ion concentrations are reported as mole percent (M %), based on silver.

Ultrathin Host Grain Emulsion E-1

An ultrathin silver iodobromide (1.5 mole % iodide) tabular grain host emulsion E-1 was prepared similarly as disclosed in example TE-15 of U.S. Pat. No. 5,962,206 using solutions of $AgNO_3$ and NaBr and a AgI suspension added in proportions so as to maintain a uniform 1.5% iodide level during crystal grain growth. The resulting emulsion was examined by scanning electron microscopy (SEM). The mean equivalent circular diameter of the emulsion was 2.16 micrometers as determined by an electric field birefringence technique. Since the tabular grains accounted for nearly all the grains present, mean grain thickness was determined using a dye adsorption technique: The level of 1,1"-diethyl-2,2"-cyanine dye required for saturation coverage was determined, and the equation for the surface area was solved assuming the solution extinction coefficient for this dye to be 77,3000 L/mole-cm and its site area per molecule to be 0.566 $nm^2$. Using this approach, the calculated grain thickness was 0.0605 micrometers.

Ultrathin Epitaxially Sensitized Emulsion E-1a

Ultrathin silver iodobromide tabular host grain emulsion E-1 was red sensitized using the following finishing procedure that led to the deposition of epitaxy on the corners of the silver halide grains. Reported levels are relative to 1 mole of host emulsion. A sample of the emulsion was liquified at 40° C. in a reaction vessel followed by the addition of 2 mole % NaCl, 0.5 mole % AgI (suspension) and 0.5 mole % NaBr. After addition of 0.5 mole % $AgNO_3$, the red sensitizing dyes RSD-2 and Benzothiazolium, 5-chloro-2-(2-((5-chloro-3-(2-hydroxy-3-sulfopropyl)-2(3H)-benzothiazolylidene)methyl)-1-butenyl)-3-(2-hydroxy-3-sulfopropyl)-, in ~1:1 mol ratio were added (~85% grain coverage) and the emulsion was held at 40° C. for 40 minutes. The dopant $K_2Ru(CN)_6$ was then added using a level of 25 μmol. This was followed by the addition of 3.73 mole % NaCl and 0.28 mole % AgI (suspension). The epitaxy was deposited after the addition of 3.75 mole % $AgNO_3$ over 1 minute. Following a 15 min hold time the epitaxial chemical sensitization was carried out. The procedure consisted of introducing 15 μmol of p-actamidophenyl disulfide, 150 mg of NaSCN, 10 μmol of 1-carboxymethyl-1,3,3-trimethyl-2thiourea (sodium salt), 1.67 μmol of Au-1-[3-(2-sulfo)benzamidophenyl]-5-mercaptotetrazole, 10 μmol of 1-(3-acetamidophenyl)-5-mercaptotetrazole, and 35 mmol of 3,5-disulfocatechol (sodium salt). After addition of the sensitizing materials, the emulsion was heated to 55° C. for 15 minutes. Then, 480 μmol of 1-(3-acetamidophenyl)-5-mercaptotetrazole was added at 40° C.

Ultrathin Epitaxially Sensitized Emulsion E-1b

Ultrathin silver iodobromide tabular host grain emulsion E-1 was red sensitized and finished with an epitaxial chemical sensitization process. Reported levels are relative to 1 mole of host emulsion. A sample of the emulsion was liquified at 40° C. in a reaction vessel followed by the addition of 2 mole % NaCl, and the pBr was then adjusted to ~4.0 with dilute $AgNO_3$. The red sensitizing dyes RSD-2 and Benzothiazolium, 5-chloro-2-(2-((5-chloro-3-(2-hydroxy-3-sulfopropyl)-2(3H)-benzothiazolylidene)methyl)-1-butenyl)-3-(2-hydroxy-3-sulfopropyl)-, in ~1:1 mol ratio were then added (~85% grain coverage) and the emulsion was held at 40° C. for 40 minutes. Then, 1.68 mole % NaBr, 0.84 mole % $CaCl_2$, 30 μmol $K_2Ru(CN)_6$ and 0.64 mole-% AgI (suspension) were introduced. The epitaxy was deposited after the addition of 3.36 mole % $AgNO_3$ over 1 min. The epitaxial chemical sensitization consisted of introducing 2.2 μmol of p-actamidophenyl disulfide, 125 mg of NaSCN, 6.25 μmol of 1-carboxymethyl-1,3,3-trimethyl-2-thiourea (sodium salt), 1.16 μmol of Au-1-[3-(2-sulfo)benzamidophenyl]-5-mercaptotetrazole, 11 μmol of 1-(3-acetamidophenyl)-5-mercaptotetrazole, and 35 mmol of 3,5-disulfocatecbol (sodium salt). After addition of the sensitizing materials, the emulsion was heated to 53° C. for 10 minutes. Then, 485 μmol of 1-(3-acetamidophenyl)-5-mercaptotetrazole was added at 40° C.

Ultrathin Epitaxially Sensitized Emulsion E-1c

The spectral and chemical sensitization processes were similar to E-1b, with the exception of introducing 0.5 mole % AgI (suspension) following the 2 mole % NaCl addition.

Actual halide compositions for epitaxial protrusions formed on emulsions E-1a, E-1b and E-1c were determined by analytical electron microscopy (AEM) techniques, and are reported in Table I below.

Single Emulsion Layer Coating Format

The single emulsion layer coating structure for this example is described below. Component laydowns are provided in units of g/m$^2$.

A cellulose acetate photographic film support with Rem Jet™ back side antihalation layer was coated with a single emulsion layer of the following composition: red sensitized ultrathin tabular emulsion E-1a, E-1b, or E-1c (silver at 0.807, gelatin at 1.08), dual coated with gelatin based (2.15) cyan dye-forming coupler CC-1 (1.61) dispersion.

The single emulsion layer was overcoated with a gelatin (2.15) overcoat layer, to provide a total gelatin coating coverage of (5.38). The hardener 1,1'-(oxybis(methylenesulfonyl))bis-ethene was added in the overcoat at 1.75% of total gelatin weight.

Multilayer Coating Format

The multilayer film structure utilized for this example is shown below, with structures of components immediately following. Component laydowns are provided in units of g/m$^2$. 1,1'-(oxybis(methylenesulfonyl))bis-ethene hardener was present at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. "Lippmann" refers to an unsensitized fine grain silver bromide emulsion of 0.05 μm diameter.

Layer 1 (Protective Overcoat Layer): gelatin (0.89).

Layer 2 (UV Filter Layer): silver bromide Lippman emulsion (0.215), LW-1 (0.097), UV-2 (0.107), CFD-1 (0.009), and gelatin (0.699).

Layer 3 (Fast Yellow Layer): a blend of two blue sensitized (with a mixture of BSD-1 and BSD-2) tabular silver iodobromide emulsions (i) 2.7×0.13 micrometer, 4.1 mole % iodide (0.312) and (ii) 1.3×0.14 micrometer, 4.1 mole % iodide (0.312), yellow dye-forming coupler YC-1 (0.258), IR-1 (0.086), bleach accelerator releasing coupler B-1 (0.005) and gelatin (0.915).

Layer 4 (Slow Yellow Layer): a blend of three blue sensitized (all with a mixture of BSD-1 and BSD-2) tabular silver iodobromide emulsions (i) 1.3×0.14 micrometer, 4.1 mole % iodide (0.323), (ii) 0.8×0.14 micrometer, 1.5 mole % iodide (0.355), and (iii) 0.5×0.08 micrometer, 1.5 mole % iodide (0.182), yellow dye-forming couplers YC-1 (0.699) and YC-2 (0.430), IR-1 (0.247), IR-2 (0.022), bleach accelerator releasing coupler B-1 (0.005), and gelatin (2.30).

Layer 5 (Interlayer): O×DS-1 (0.075), A-1 (0.043), and gelatin (0.538).

Layer 6 (Fast Magenta Layer): a green sensitized (with a mixture of GSD-1 and GSD-2) silver iodobromide tabular emulsion, 1.3×0.13 micrometer, 4.5 mole % iodide (0.775); magenta dye-forming coupler MC-1 (0.102), masking coupler MM-1 (0.032), IR-3 (0.036), IR-4 (0.003) and gelatin (1.03).

Layer 7 (Mid Magenta Layer): a blend of two green sensitized (with a mixture of GSD-1 and GSD-2) silver iodobromide tabular emulsions (i) 0.8×0.12 micrometer, 4.5 mole % iodide (0.71) and (ii) 0.7×0.11 micrometer, 4.5 mole % iodide (0.151), magenta dye-forming coupler MC-1 (0.247), masking coupler MM-1 (0.118), IR-3 (0.027), IR-5 (0.024), and gelatin (1.45).

Layer 8 (Slow magenta layer): a blend of three green sensitized (all with a mixture of GSD-1 and GSD-2) silver iodobromide emulsions (i) 0.7×0.11 micrometer tabular, 4.5 mole % iodide (0.172), (ii) 0.5×0.11 micrometer tabular, 4.5 mole % iodide (0.29), and (iii) 0.28 micrometer cubic, 3.5 mole % iodide (0.29); magenta dye-forming coupler MC-1 (0.430), masking coupler MM-1 (0.108), IR-5 (0.031) and gelatin (1.52).

Layer 9 (Interlayer): YFD-1 (0.043), A-1 (0.043), O×DS-1 (0.081) and gelatin (0.538).

Layer 10 (Fast Cyan layer): red-sensitized ultrathin tabular silver iodobromide emulsion E-1a, E1-b, or E-1c (0.860); cyan dye-forming couplers CC-1 (0.199), IR-6 (0.043), IR-7 (0.059), masking coupler CM-1 (0.027), and gelatin (1.62).

Layer 11 (Mid Cyan Layer): a blend of two red-sensitized (both with a mixture of RSD-1, RSD-2, and RSD-3) silver iodobromide tabular emulsions (i) 1.2×0.11 micrometer, 4.1 mole % iodide (0.344) and (ii) 1.0×0.11 micrometer, 4.1 mole % iodide (0.430); cyan dye-forming coupler CC-1 (0.344), IR-2 (0.038), masking coupler CM-1 (0.016), and gelatin (1.13).

Layer 12 (Slow cyan layer): a blend of two red sensitized (both with a mixture of RSD-1, RSD-2, and RSD-3) tabular silver iodobromide emulsions (i) 0.7×0.12 micrometer, 4.1 mole % iodide (0.484) and (ii) 0.5×0.08 micrometer, 1.5 mole % iodide (0.646); cyan dye-forming coupler CC-1 (0.583), IR-7 (0.034), masking coupler CM-1 (0.011), bleach accelerator releasing coupler B-1 (0.086) and gelatin (1.92).

Layer 13 (Interlayer): O×DS-1 (0.075) and gelatin (0.538).

Layer 14 (Antihalation layer): Black Colloidal Silver (0.151), O×DS-1 (0.081), and gelatin (1.61).

Support: annealed poly(ethylene naphthalate)

UV-1

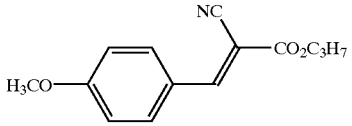

UV-2

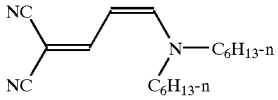

YC-1

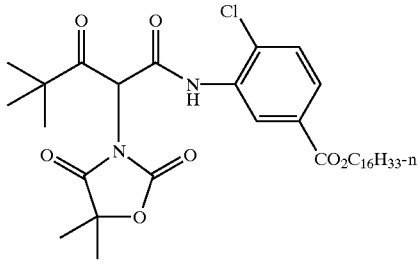

YC-2

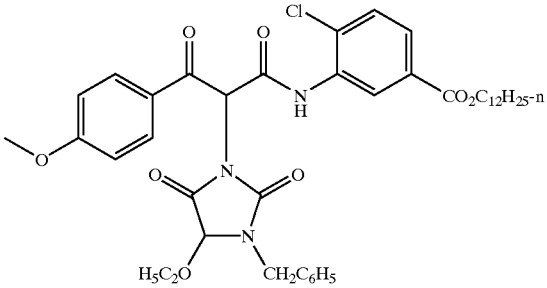

IR-1

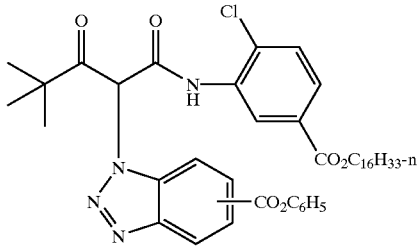

-continued

IR-2

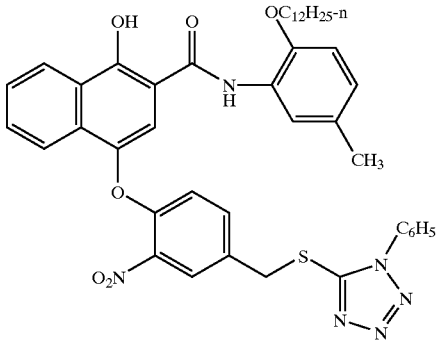

B-1

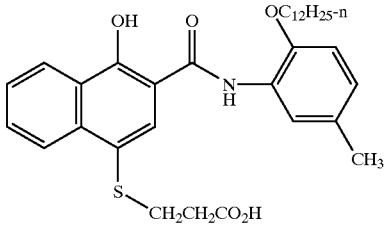

BSD-2

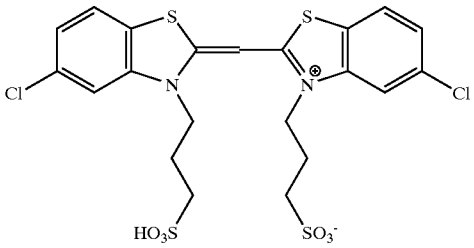

BSD-1

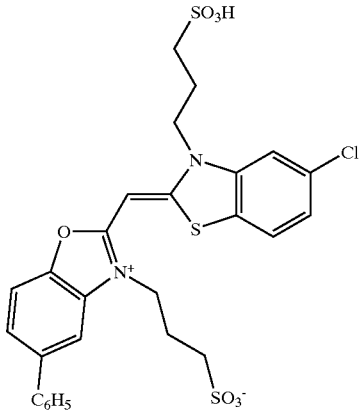

YFD-1

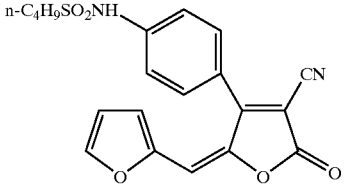

-continued
OxDS-1
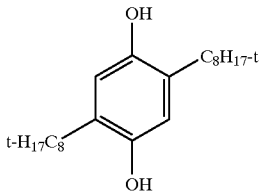
A-1
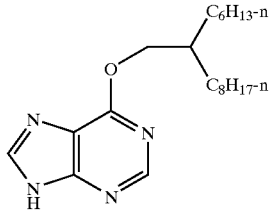
GSD-2
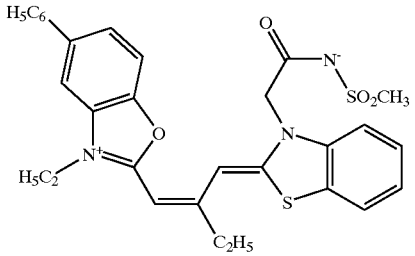
GSD-1
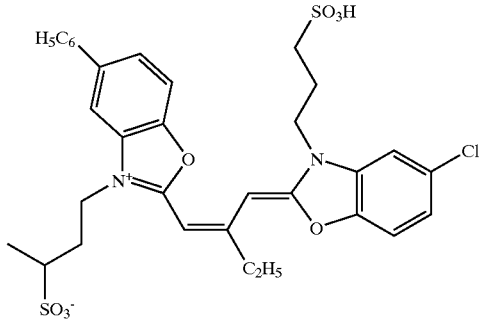
MC-1
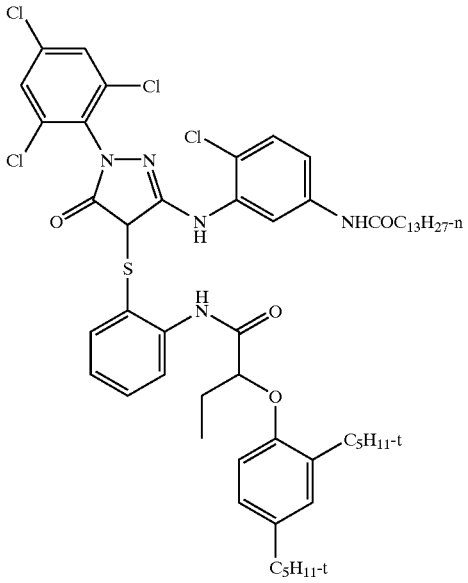
-continued
MM-1
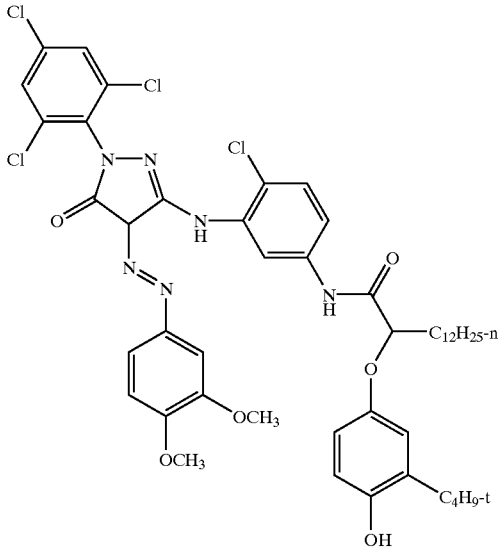
IR-3
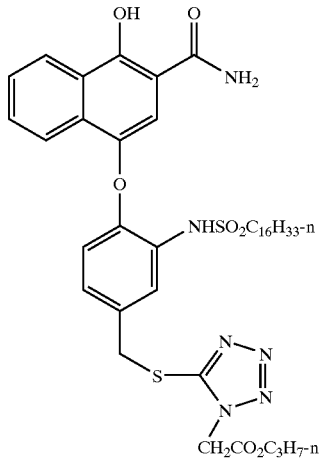
IR-5
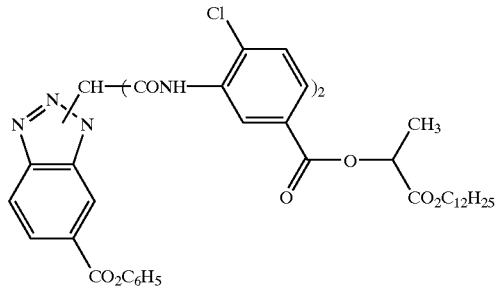

-continued
IR-4
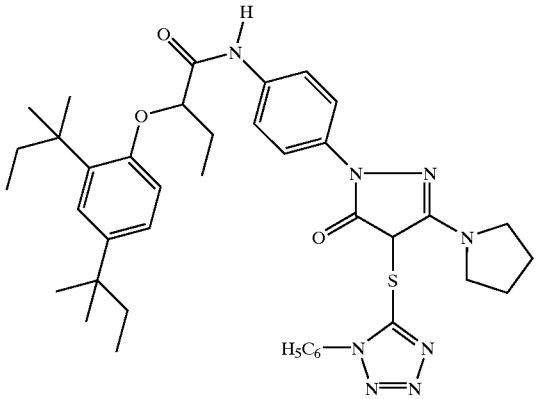
RSD-1
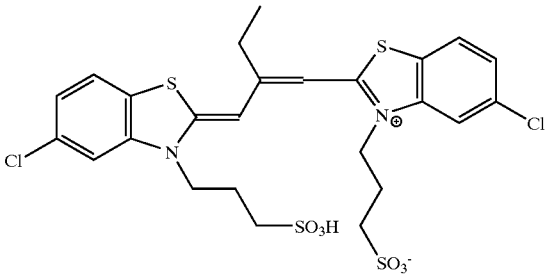
RSD-2
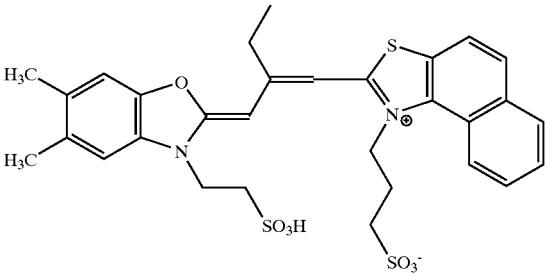
RSD-3
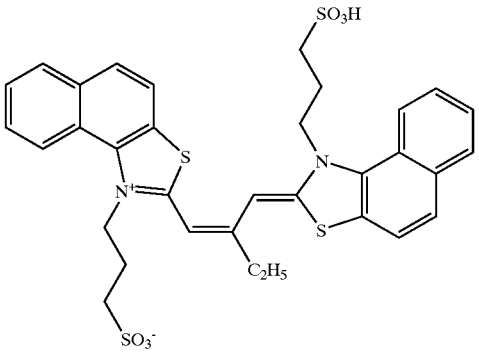
-continued
CM-1
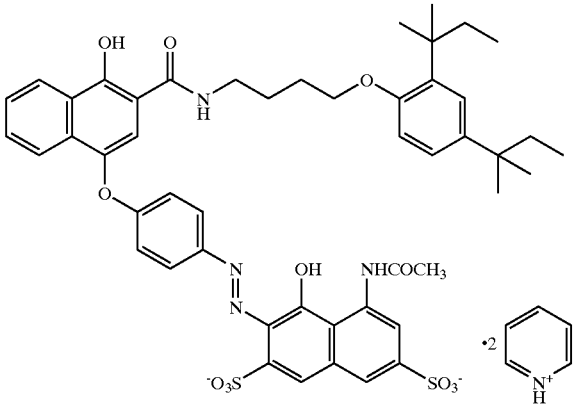
CC-1
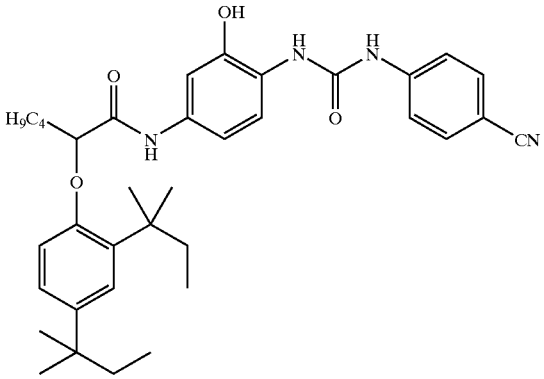
CFD-1
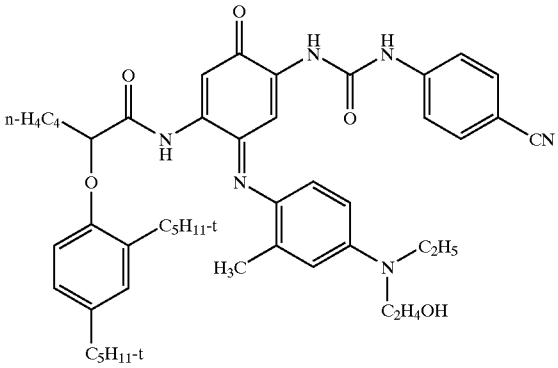
IR-6
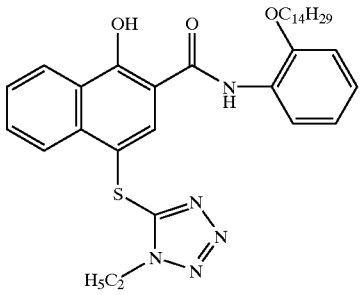

-continued

IR-7

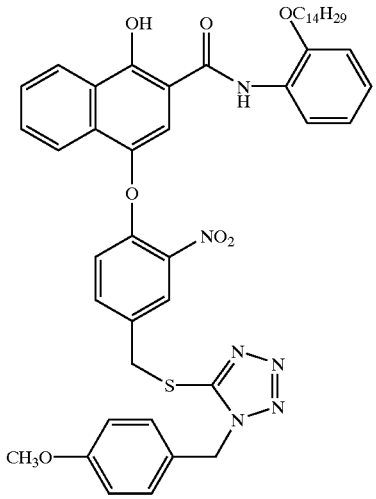

Exposure, Processing and Speed Measurements

Spectral exposures for single layer coatings were made with 5500 K daylight using a 21-step granularity tablet with a Wratten 23A filter for 1/100 sec. The exposed strips were then developed in a C-41 process for 160 sec. Red speed was measured at 0.15 above minimum density, with the results indicated in Table I below.

The speed of the multilayer coatings were determined by exposing the coating to white light at 5500 K using a calibrated graduated density test object for an exposure time of 0.02 sec. The exposed coatings were then developed for 195 sec at 38° C. using the known C-41 color process. Red speed was measured at 0.15 above minimum density, with the results indicated in Table I below.

TABLE 1

Correlation of Epitaxial Halide Composition by AEM and Observed Red Speed for Single Layer (SL) and Multilayer (ML) Formats

| Emulsion | Addition of 0.5% Surface I | Nominal Epitaxy | Actual Epitaxy % Cl | % Br | % I | Relative Log Speed (SL) | Relative Log Speed (ML) |
|---|---|---|---|---|---|---|---|
| E-1a (Invention) | Yes | $AgCl_{0.93}I_{0.07}$ | 34.4 | 62 | 3.6 | 309 | 300 |
| E-1b (Invention) | No | $AgCl_{0.42}Br_{0.42}I_{0.16}$ | 24.7 | 71.4 | 3.9 | 302 | 298 |
| E-1c (Comparison) | Yes | $AgCl_{0.42}Br_{0.42}I_{0.16}$ | 15.5 | 74.5 | 10 | 307 | 286 |

As demonstrated by the above results, use of epitaxially sensitized ultrathin emulsions E-1a and E-1b having actual epitaxial halide concentrations in accordance with the invention in a multilayer format in combination with other high bromide tabular grain emulsions results in significantly less loss in speed than that observed for comparison ultrathin emulsion E-1c. Note that while emulsions E-1b and E-1c were epitaxially sensitized in the presence of the same nominal halide concentrations, the actual epitaxial concentrations differed significantly due to the presence or absence of a surface iodide treatment step. Also note that a significantly different actual halide concentration for the epitaxial deposit of emulsion E-1c is observed compared to that for emulsion C-3 in the examples of U.S. Pat. No. 5,576,168 (i.e., 28.4% Cl, 64.5% Br and 7.2% I), even though both epitaxial sensitizations were obtained using a surface iodide treatment step and the same nominal halide epitaxy concentrations. The actual concentration difference is due to the different level of epitaxial deposition (i.e., 4 mole % for emulsion E-1c versus 12 mole % for emulsion C-3).

The invention has been described in detail with particular reference to preferred embodiments thereof, but it will be understood that variations and modifications can be effected within the spirit and scope of the invention.

What is claimed is:

1. A photographic element comprising a support bearing (i) a first radiation-sensitive silver halide emulsion image-forming layer comprising a tabular grain emulsion comprised of silver halide grains including tabular grains
having {111} major faces,
containing greater than 50 mole percent bromide, based on silver,
accounting for greater than 50 percent of total grain projected area, and
exhibiting an average thickness of at least 0.07 μm and an average aspect ratio of at least 2; and (ii) a second radiation-sensitive silver halide emulsion image-forming layer comprising an ultrathin tabular grain emulsion comprised of silver halide grains including tabular grains
having {111} major faces,
containing greater than 70 mole percent bromide and at least 0.25 mole percent iodide, based on silver,
accounting for greater than 90 percent of total grain projected area,
exhibiting an average thickness of less than 0.07 μm and an average equivalent circular diameter of at least 0.7 μm, and
having latent image forming chemical sensitization sites on the surfaces of the tabular grains, wherein the surface chemical sensitization sites include epitaxially deposited silver halide protrusions forming epitaxial junctions with the tabular grains, the protrusions
exhibiting an isomorphic face centered cubic crystal lattice structure,
located on up to 50 percent of the surface area of the tabular grains,
containing an actual chloride concentration of from 20–50 mole %, based on epitaxially deposited silver, the chloride concentration being at least 10 mole percent higher than that of the tabular grains, and
containing an actual iodide concentration of from 1 to 7 mole %, based on epitaxially deposited silver.

2. An element according to claim 1, wherein the epitaxially deposited silver halide protrusions of the ultrathin tabular grain emulsion comprise from 0.5–7 mole percent based on total silver of the host tabular grains.

3. An element according to claim 2, wherein the epitaxially deposited silver halide protrusions of the ultrathin tabular grain emulsion comprise from 1–6 mole percent based on total silver of the host tabular grains.

4. An element according to claim 2, wherein the epitaxially deposited silver halide protrusions of the ultrathin tabular grain emulsion comprise from 3–6 mole percent based on total silver of the host tabular grains.

5. An element according to claim 2, wherein the tabular grains of the second silver halide emulsion layer having a thickness of less than 0.07 μm comprise from 1 to 25 wt % of the total imaging silver halide content of the element.

6. An element according to claim 5, wherein the tabular grains of the second silver halide emulsion layer having a thickness of less than 0.07 μm comprise from 1 to 20 wt % of the total imaging silver halide content of the element.

7. An element according to claim 5, wherein the tabular grains of the second silver halide emulsion layer having a thickness of less than 0.07 μm comprise from 1 to 15 wt % of the total imaging silver halide content of the element.

8. An element according to claim 2, comprising at least one radiation-sensitive silver halide emulsion image forming layer sensitive to blue light, one or more such layers sensitive to green light, and one or more such layers sensitive to red light.

9. An element according to claim 1, wherein the tabular grains of the second silver halide emulsion layer having a thickness of less than 0.07 μm comprise from 1 to 25 wt % of the total imaging silver halide content of the element.

10. An element according to claim 9, wherein the tabular grains of the second silver halide emulsion layer having a thickness of less than 0.07 μm comprise from 1 to 20 wt % of the total imaging silver halide content of the element.

11. An element according to claim 9, wherein the tabular grains of the second silver halide emulsion layer having a thickness of less than 0.07 μm comprise from 1 to 15 wt % of the total imaging silver halide content of the element.

12. An element according to claim 1, comprising at least one radiation-sensitive silver halide emulsion image forming layer sensitive to blue light, one or more such layers sensitive to green light, and one or more such layers sensitive to red light.

* * * * *